US006016288A

United States Patent [19]

Frith

[11] Patent Number: 6,016,288

[45] Date of Patent: Jan. 18, 2000

[54] SERVO-DRIVEN MUD PULSER

[75] Inventor: Terrence G. Frith, Lafayette, La.

[73] Assignee: Thomas Tools, Inc., New Iberia, La.

[21] Appl. No.: 08/687,207

[22] Filed: Jul. 25, 1996

Related U.S. Application Data

[63] Continuation-in-part of application No. 08/349,188, Dec. 5, 1994, abandoned.

[51] Int. Cl.[7] ..... G01V 1/40

[52] U.S. Cl. ..... 367/85; 367/83; 181/102

[58] Field of Search ..... 367/85, 83, 81, 367/912, 134; 175/246; 181/102

[56] References Cited

U.S. PATENT DOCUMENTS

| | | |
|---|---|---|
| 2,329,732 | 9/1943 | Varney . |
| 2,435,934 | 2/1948 | Varney . |
| 2,524,031 | 10/1950 | Arps . |
| 2,677,790 | 5/1954 | Arps . |
| 2,755,431 | 7/1956 | Scherbatskoy . |
| 2,759,143 | 8/1956 | Arps . |
| 2,787,759 | 4/1957 | Arps . |
| 2,890,019 | 6/1959 | Arps . |
| 2,925,251 | 2/1960 | Arps . |
| 2,978,634 | 4/1961 | Arps . |
| 3,065,416 | 11/1962 | Jeter . |
| 3,622,971 | 11/1971 | Arps . |
| 3,693,428 | 9/1972 | LePeuvedic . |
| 3,713,089 | 1/1973 | Claycomb . |
| 3,737,843 | 6/1973 | LePeuved . |
| 3,863,203 | 1/1975 | Patton . |
| 3,908,453 | 9/1975 | Jeter . |
| 3,958,217 | 5/1976 | Spinnier . |
| 3,958,678 | 5/1976 | Jeter . |
| 4,009,613 | 3/1977 | Jeter . |
| 4,034,833 | 7/1977 | Jeter . |
| 4,078,620 | 3/1978 | Westlake . |
| 4,120,097 | 10/1978 | Jeter . |
| 4,184,545 | 1/1980 | Claycomb . |
| 4,351,037 | 9/1982 | Scherbatskoy . |
| 4,386,422 | 5/1983 | Mumby . |
| 4,405,021 | 9/1983 | Mumby . |
| 4,520,468 | 5/1985 | Scherbatskoy . |
| 4,535,429 | 8/1985 | Russell . |
| 4,550,392 | 10/1985 | Mumby . |
| 4,553,226 | 11/1985 | Scherbatskoy . |
| 4,562,560 | 12/1985 | Kamp . |
| 4,630,244 | 12/1986 | Larronde . |
| 4,636,995 | 1/1987 | Russell . |
| 4,641,289 | 2/1987 | Jurgens . |
| 4,675,852 | 6/1987 | Russell . |
| 4,686,658 | 8/1987 | Davison . |
| 4,689,775 | 8/1987 | Scherbatskoy . |
| 4,694,439 | 9/1987 | Moll . |
| 4,698,794 | 10/1987 | Kruger . |
| 4,699,352 | 10/1987 | Mumby . |
| 4,703,461 | 10/1987 | Kotlyar . |
| 4,724,498 | 2/1988 | Takikawa . |
| 4,742,498 | 5/1988 | Barron . |
| 4,817,739 | 4/1989 | Jeter . |
| 4,825,421 | 4/1989 | Jeter . |
| 4,904,865 | 2/1990 | Meisner . |
| 5,020,609 | 6/1991 | Jeter . |
| 5,061,849 | 10/1991 | Meisner . |
| 5,081,419 | 1/1992 | Meador . |
| 5,103,430 | 4/1992 | Jeter ..... 367/85 |
| 5,115,415 | 5/1992 | Mumby . |
| 5,117,398 | 5/1992 | Jeter . |
| 5,333,686 | 8/1994 | Vaughan . |
| 5,348,091 | 9/1994 | Tchakarov . |
| 5,586,084 | 12/1996 | Barron et al. ..... 367/85 |

*Primary Examiner*—Christine Oda
*Assistant Examiner*—Anthony Jolly
*Attorney, Agent, or Firm*—Vinson & Elkins, L.L.P.

[57] ABSTRACT

An improved servo-driven pulser is disclosed, for use in measurement while drilling applications. In the pulser, a battery powered on-board DC electric motor is used to operate a servo-valve, which in turn adjusts internal tool fluid pressures to cause operation of a main valve to substantially reduce mud flow to a drill bit, thereby creating a positive pressure pulse detectable at the surface. De-energizing the motor driving the pilot valve results in re-adjustment of internal fluid pressures, causing the main valve to reopen, thereby terminating the pressure pulse.

34 Claims, 7 Drawing Sheets

SERVO-DRIVEN MUD PULSER

BACKGROUND OF THE INVENTION

This application is a continuation-in-part of U.S. application Ser. No. 08/349,188 filed Dec. 5, 1994 now abandoned.

FIELD OF THE INVENTION

This invention relates to the field of MWD ("measurement while drilling") technology for the wireless telemetry logging of wells during drilling operations, and more particularly to an improved valve for generating "mud pulse" telemetry signals in the drilling mud during drilling operations.

PRIOR ART

In the drilling of deep bore holes such as oil and gas wells, it is desirable to monitor certain downhole conditions and to transmit information on these conditions to the surface. For example, information on such downhole conditions as temperature, pressure, bore hole orientation or deviation from the vertical, and a variety of geophysical data relating to the formation in which the bit is drilling are of interest to the driller. Such variables typically are monitored by a variety of prior art sensors with transducers which convert the parameters into electrical signals for transmission directly to the surface via electrical conductors, or which are used to command some form of wireless telemetry system for transmitting a surface detectable signal.

Direct or "hardwired" transmission systems present significant difficulty in that cable or similar conductors used for transmitting the signals are susceptible to damage and are awkward to manipulate during drilling. The more common approach in the drilling industry is to utilize pressure pulses in the circulating drilling fluid ("mud") which pulses are propagated to the surface through the flowing column of drilling mud. The pressure pulses typically represent binary coded digital signals and are analogous to the variable being measured. The binary coded signals then are decoded by digital computers at the surface in order to interpret the data.

Two types of MWD mud pulse telemetry are utilized in the industry. Positive pulse systems use a downhole valve which restricts or briefly blocks mud flow to the drill bit in order to produce a surface detectable pressure increase or positive pulse. Negative pulse systems bypass the pressure drop across the bit by briefly opening a flow passage to the annulus from the drill stem interior above the bit, thus producing a surface detectable pressure decrease or negative pulse.

Examples of negative pulse MWD signal generators are provided, for example, in U.S. Pat. No. 4,386,422 issued May 31, 1983, entitled "Servo Valve for Well-Logging Telemetry" and U.S. Pat. No. 4,405,021 issued Sept. 28, 1983, entitled "Apparatus for Well Logging While Drilling." A principal drawback with such negative pulse generators is that, if the valve fails in the bypass mode, substantial drilling fluid energy will be lost into the annulus, bypassing the bit, and decreasing drilling efficiency. A secondary drawback is that negative pulses, by their nature, are more difficult to detect and more easily lost in the general background noise of the flowing column of drilling mud. For these reasons, positive pulse generators are more widely used.

Examples of positive pulse mud signal generators are provided, for example, by U.S. Pat. No. 5,103,430 issued Apr. 7, 1992, entitled "Mud Pulse Pressure Signal Generator;" and by U.S. Pat. No. 4,550,382 issued Oct. 29, 1985, and its divisional U.S. Pat. No. 4,699,352 issued Oct. 13, 1987, both entitled "Apparatus for Well Logging Telemetry."

A principal object in the design of MWD mud pulsing tools is to provide a pulse generator which can operate reliably in the hostile environment produced by the exposure to drilling mud and other downhole conditions. The present invention has a unique servo valve assembly which is designed to be more reliable than current art. Two features which distinguish the servo assembly from others is that it has no reciprocating parts exposed to the mud environment, other than the servo valve shaft, and also has no "dead space" cavities or chambers exposed to drilling mud which would allow solids and debris to accumulate.

Another principal object in the design of MWD mud pulsing tools is to provide a device which consumes a minimum amount of electrical power. All current retrievable mud pulsing tools receive their power from electrical storage batteries, which are included as part of the MWD string. When battery power is expended, the tools must be retrieved from the borehole to replace the batteries—a costly and time consuming process. Motors or solenoids are the primary driving means of most current art MWD tools. The present invention provides a MWD positive pulse generator which is more power efficient due to the unique servo valve design consisting of a low power consumption motor which greatly extends battery life. The primary unique feature of the servo assembly operation which contributes to this efficiency is that the servo valve is electrically powered for only half its cycle (opening or closing), with the other half of the cycle being spring powered. Therefore, timing of the cycle can be controlled electrically or mechanically to reach an optimum system for power consumption and reliability. Also, the assembly utilizes a ball nut and lead screw preferably having a diameter to pitch ratio of 3 to 1 or less, which is lower than other current art. A higher diameter to pitch ratio would require a stronger spring force to reliably close the valve. While a stronger spring force could be provided, it would require a more power consuming motor to provide the necessary torque to overcome the spring means during the opening cycle.

These and other objects, advantages and features of the invention will be apparent to those skilled in the art from a consideration of the following specification, including the claims and appended drawings.

SUMMARY OF THE INVENTION

The MWD mud pulsing tool according to the present invention comprises a tool which can be run on a wireline into the bore of the drill pipe, seated on a pre-run muleshoe helix seat, or the like, and later wireline retrieved for removal or servicing. The tool preferably includes an electrical power source, such as a conventional nickel cadmium electrical storage battery, and an electrical flow switch which automatically activates the tool's electronics when mud is flowing in the drill string and deactivates the electronics when no mud is flowing, in order to conserve battery power. An ironless rotor DC motor is electrically powered to drive a planetary gear which in turn powers a threaded drive shaft mounted in a bearing assembly to rotate a ball nut lead screw. The rotating threaded shaft lifts the lead screw, which is attached to the pilot valve, so as to lift the pilot valve off of its seat. When the pilot valve is lifted off of its seat, fluid pressures across a main valve piston are equalized, permitting a biasing spring to cause the main valve shaft to extend into the main valve orifice, to substantially reduce mud flow to the bit, creating a positive pressure pulse detectable at the surface.

Closure of the main valve also causes a decrease in pressure in those internal parts of the tool where the fluid pressure is communication with the downstream portion of the tubing (below the main valve) and an increase in the fluid pressures in those parts of the tool which are in fluid communication with the mud in the tubing annulus above the main valve. As the electrically driven pilot valve reaches the upper limit of its movement, the electrical motor powering the pilot valve is automatically de-energized. This causes the ball nut and lead screw on the threaded shaft to "free wheel" downward, responsive to energy stored in a metal bellows attached to the pilot valve, until the pilot valve reseats on the pilot valve seat. Closing the pilot valve has the effect of placing the top part of main valve piston in communication with the low pressure downstream mud, while the bottom of the piston is exposed to higher pressure upstream mud. This pressure differential overcomes the closing effect of the main valve spring, causing the main valve to reopen. The time required for a cycle (closing and reopening) of the main valve is controlled by the speed at which the pilot valve opens to the point that the opening motor is de-energized, and the speed at which pilot valve then free wheels closed under the influence of the closing spring bellows. The pilot valve will remain closed, and the main valve open, until the motor is re-energized by a signal from the well logging electronics, at which time the cycle will be repeated.

An alternate embodiment of the invention also is shown. The alternate embodiment is most useful in larger bore tubing, which can more easily tolerate a permanent mud flow restriction from a main valve orifice permanently in the mud flow path. In the alternate embodiment, the main valve orifice is provided in an orientation sub which is made up in the tubing string at the time the string is run into the well bore. The pulser tool is then run into the tubing string on a wire line and seated in the orientation sub, just above the main valve orifice. Responsive to opening of the pilot valve, as discussed above, the main valve extends below the bottom of the pulser tool and into the main valve orifice, in order to generate the positive mud pulse, and retracts out of the main valve orifice when the pilot valve closes.

DESCRIPTION OF SPECIFIC EMBODIMENTS

In the preferred embodiments of the invention, as described in detail below, pressure pulses are transmitted through the drilling fluid in the drill string to send information from the lower part of the well bore to the surface as the well is drilled. At least one downhole condition within the well is sensed, and a signal, usually analog, is generated to represent the sensed condition. The signal controls the closing of the main valve in the mud pulser tool to cause a substantial interruption of mud flow to the drill bit, resulting in a positive pressure pulse which migrates up the column of drilling mud as part of a coded sequence of pressure pulses representing the downhole condition. The sequence of mud pulses are sensed and decoded at the surface to provide a reading of the sensed downhole condition.

Figure 1:
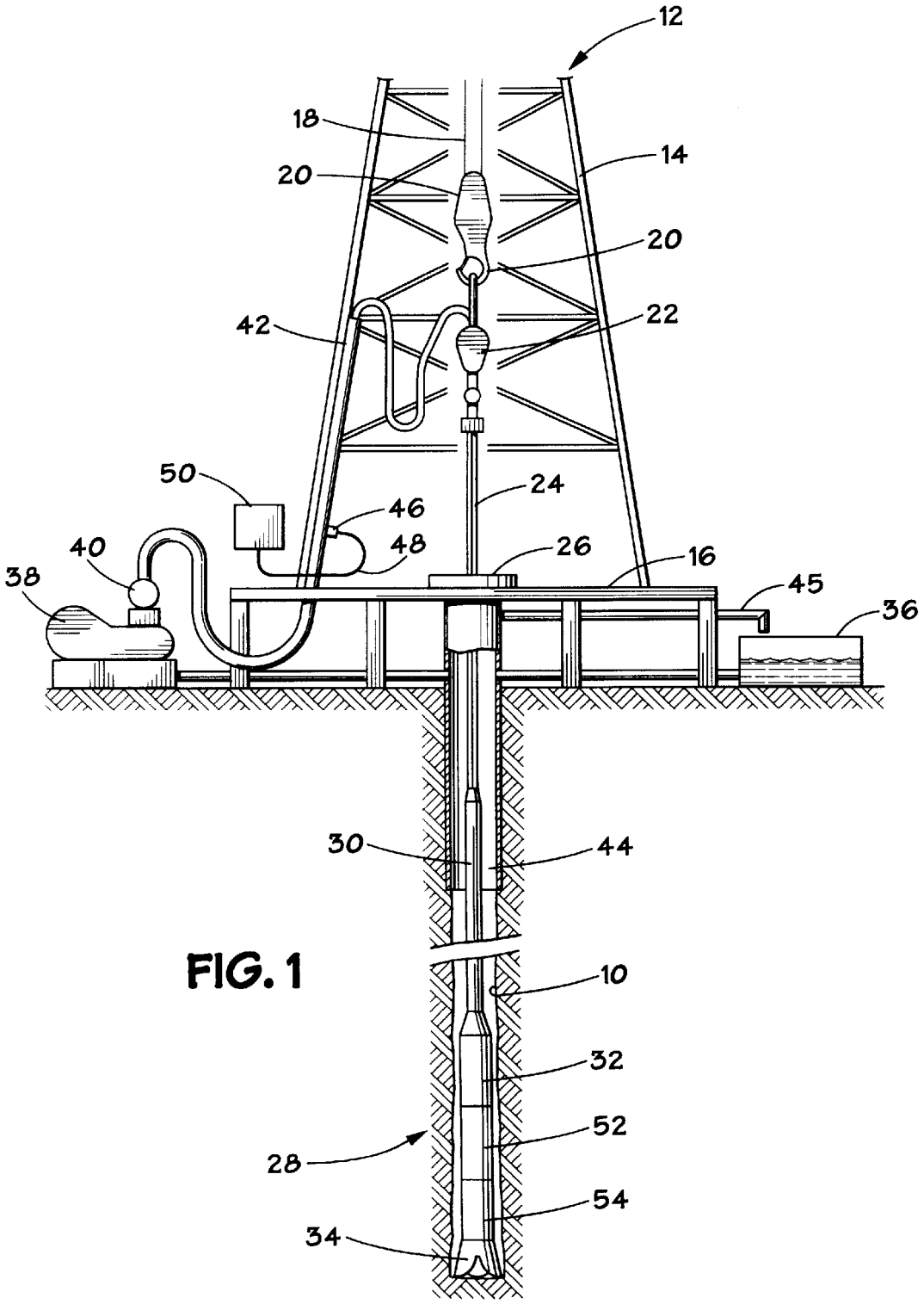
FIG. 1 is a somewhat schematic illustration of the surface and downhole portions of a well drilling apparatus used in connection with the MWD mud pulsing tools of the present invention.

Referring to FIG. 1, a well bore 10 is drilled in the earth with a rotary drilling rig 12 which includes the usual derrick 14, derrick floor 16, draw works 18, hook 20, swivel 22, kelly joint 24 and rotary table 26. A drill string 28 made up of sections of drill pipe 30 secured to the lower end of the kelly joint 24 extends into the upper end of one or more drill collars 32 which carry the drill bit 34. Drilling fluid, commonly called drilling mud, circulates from a mud pit 36 through a mud pump 38, desurger 40, a mud supply line 42 and into the swivel 22. The drilling mud flows down through the kelly joint, drill string, drill collars and out through nozzles (not shown) in the lower face of the drill bit. The drilling mud flows back up through the annular space 44 between the outer diameter of the drill string and the well bore to the surface, where it is returned to the mud pit through a mud return line 45. The usual shaker screen for separating formation cuttings from the drilling mud before it returns to the mud pit is not shown.

A transducer 46 in the mud supply line 42 detects variations in drilling mud pressure at the surface. The transducer generates electrical signals responsive to the drilling pressure variations. These signals are transmitted by an electrical conductor 48 to a surface electronic processing system 50 such as that described in U.S. Pat. No. 4,078,620.

A nonmagnetic drilling collar 52 may be inserted between the drill collar 32 and the drill bit and may carry the mud pulser of the present invention. Alternatively, the mud pulser may be carried in a section of drill pipe above the drill collars. For some operations, such as horizontal drilling, a hydraulic drilling motor 54 also may be inserted in the drill string between the drill collars and the bit. Such a motor, if present, utilizes fluid pressure from the flowing mud to rotate the drill bit.

Figure 4:
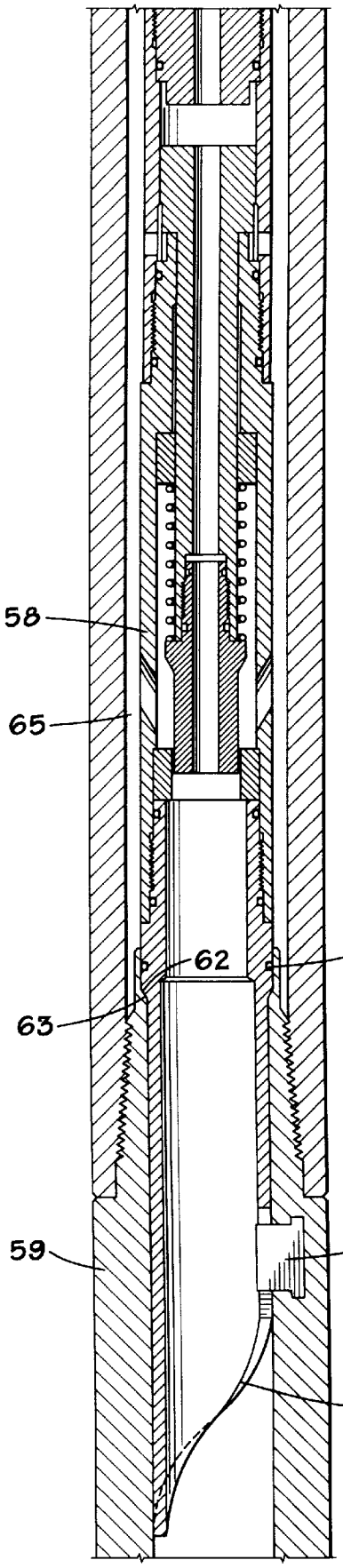
FIG. 4 is a view in elevation and partly in section of the lower portion of the tool of FIG. 3*b*, and also illustrating the orientation sub and orientation key used for seating and orienting the pulser tool in the drill string.

The pulser tool 56 in accordance with the present invention comprises an elongated cylindrical housing 58 made up of a plurality of individual threadedly connected tubular sections. When in use, the tool is disposed inside the lower portion of the drill string and is surrounded by flowing drilling mud. As shown in FIG. 4, the bottom-most section of the tool housing comprises a conventional muleshoe stinger 60, having a downwardly facing helical surface on the lower end thereof, which is adapted to cooperate with an orientation sub 59 and orientation key 61 in the drill string in the manner well known to those skilled in the art to seat and orient the tool with respect to the drill string. A downwardly facing shoulder 62 on the muleshoe stinger cooperates with a corresponding upwardly facing shoulder 63 in the orientation sub to provide a seat for the pulser. The orientation sub may be part of the nonmagnetic drill collar 52, or may be inserted elsewhere in the lower portion of the drill string. An O-ring seal 64 engages the wall of the orientation sub to prevent flow of drilling fluid around the pulser tool. All drilling fluid then must pass down the annulus 65 between the pulser tool and the drill string wall and through the pulser tool as described hereinafter.

Figure 2A:
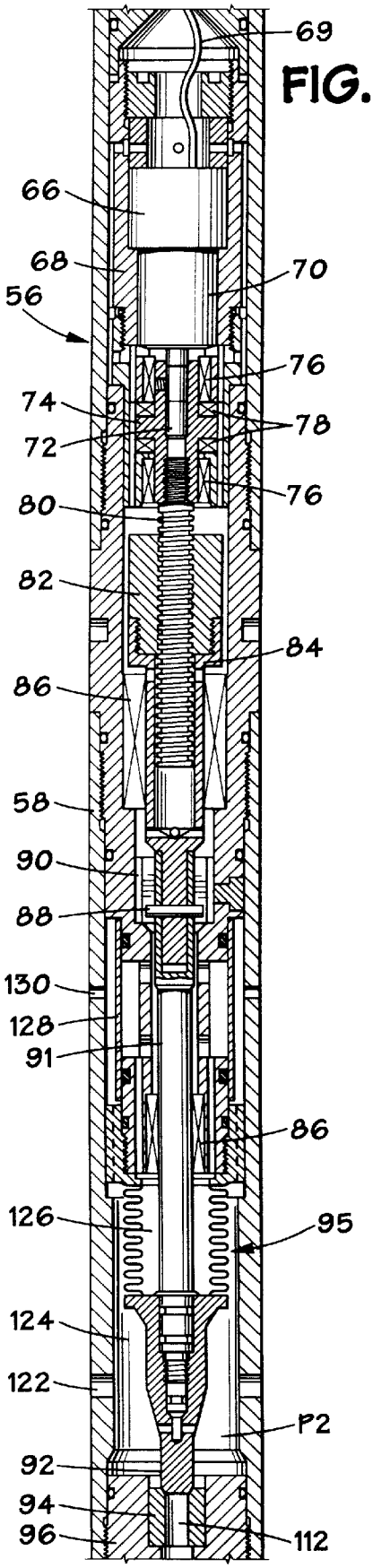
FIG. 2*a* is a view in elevation and partly in section of the upper portion of a mud pulser tool in accordance with the present invention, illustrated with the pilot valve in the closed position.
Figure 2B:
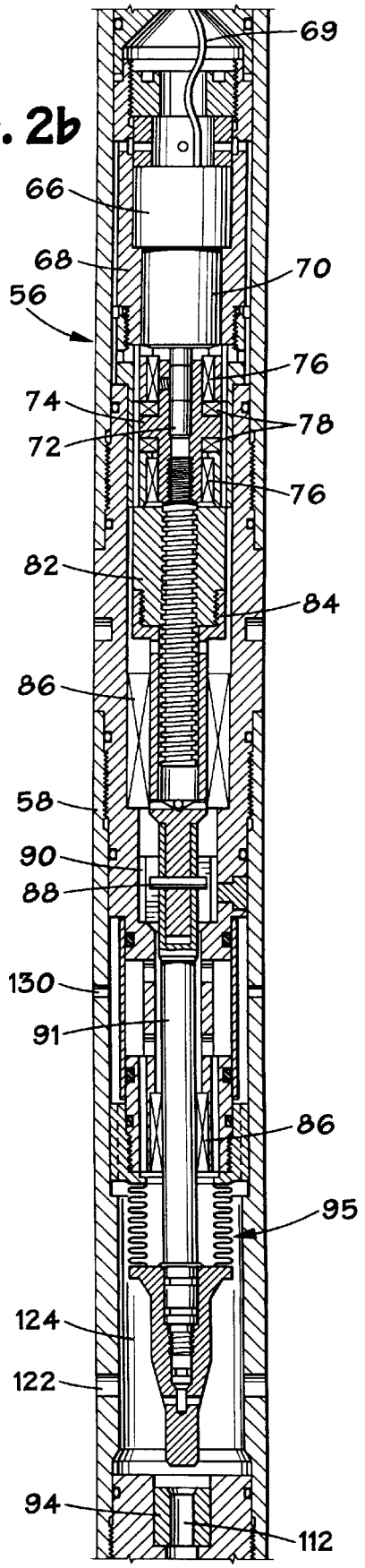
FIG. 2*b* is a view similar to 2*a*, illustrating the arrangement of the same parts of the tool with the pilot valve in the open position.
Figure 3A:
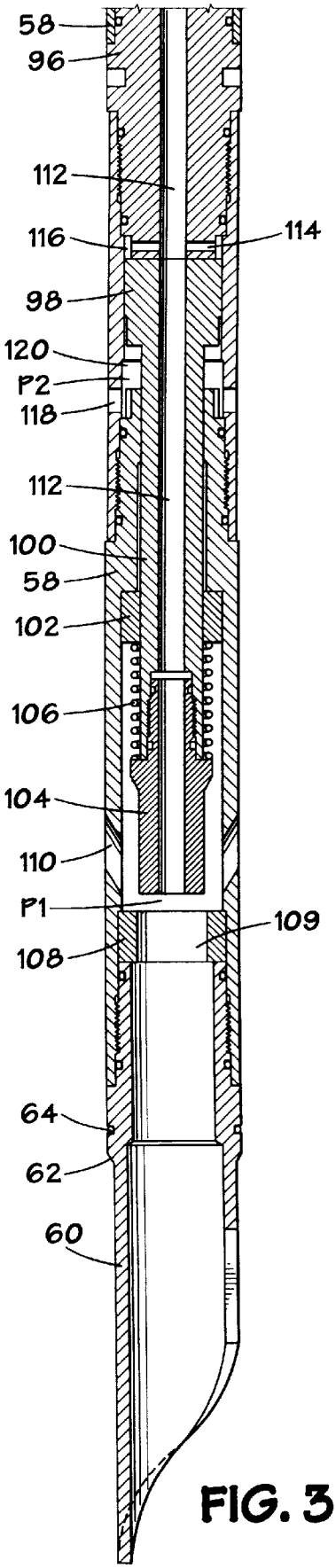
FIG. 3*a* is a view in elevation and partly in section, comprising a continuation of the lower part of the MWD mud pulser tool of FIG. 2*a*, showing the main valve in the open position.
Figure 3B:
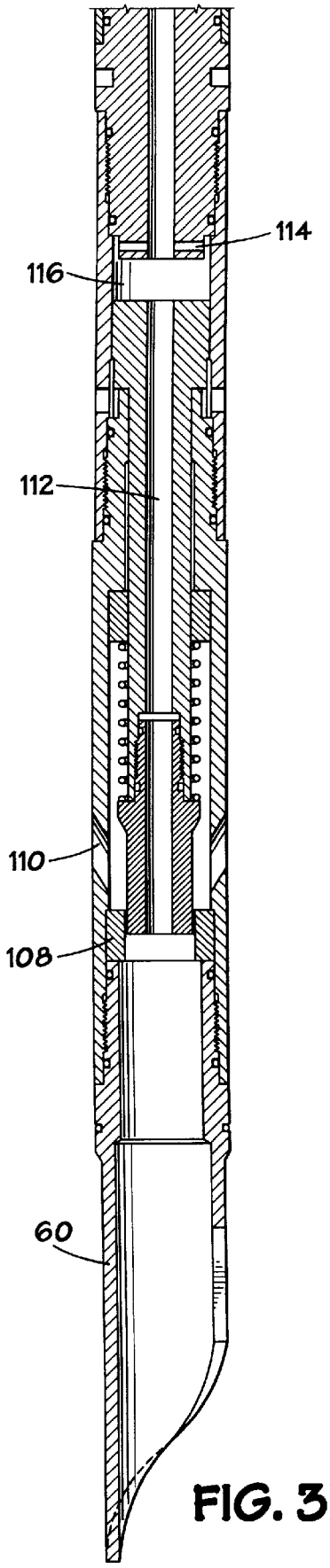
FIG. 3*b* is a view similar to FIG. 3*a*, illustrating the same parts of the tool with the main valve in its closed position.

Referring to FIGS. 2*a* and 3*a*, there are illustrated details of the construction of the pulser mechanism with the main valve open, so that the pulser is not generating a pressure pulse. Aligned FIGS. 2*b* and 3*b* illustrate the same portions of the pulser in the positions they would occupy with the main valve closed, substantially reducing the flow of drilling mud through the tool and generating a positive pressure pulse. It will be appreciated that the entire pulser tool 56 is contained in the drill string and surrounded by an annulus 65, as illustrated in FIG. 4. However, in FIGS. 2*a*, 2*b* and 3*a*, 3*b*, the surrounding parts of the drill string, and the annulus between the drill string and the tool, are omitted for simplicity of illustration. The uppermost portion of the pulser tool also is omitted from the illustrations, but may comprise any desired arrangement of prior art components such as sensors and transducers for sensing one or more downhole parameters and creating an analog signal proportionate to the sensed parameter, a battery pack or other electrical power source and a switch for actuating the electrical power source to power the electrical components of the pulser when mud is flowing in the drill string and down through the annulus 65 between the outside diameter of the pulser tool and the inside diameter of the tool joint in which the tool is carried. Also not shown, at the upper end of the tool, there will be provided an overshot engagement means for permitting the tool to be run into the well bore on a wire line and retrieved in a similar manner.

Although the tool of the present invention operates on the principle of pressure differentials, there preferably are no protrusions into the annulus between the outside diameter of the tool and the inside diameter of the tubing string, such as are used in some prior art tools to create increased pressure drops along the length of the pulser tool.

Near the upper end of that portion of the tool shown in FIG. 2*a*, there is provided an ironless rotor DC motor 66 carried in an alignment housing 68. A planetary type gear 70 is provided below the motor and centered by the same alignment housing 68. The ironless rotor DC motor preferably is a Maxon™ ironless rotor DC motor which is a small diameter (0.970 inch outside diameter), high speed (1,000 RPM @ 20 volts), high torque (4.5 oz-in max) motor, that draws a maximum of 1.1 amp. When combined with the 4.4 to 1 ratio planetary gearhead, the Maxon motor can produce 7.6 ounce-inches of continuous torque at only 0.50 amps current draw. The high torque to speed ratio, therefore, is one distinct advantage, especially considering the minimal power consumption, and small size. Another distinct feature of this motor is that it is operationally power efficient. The motor uses only as much current as torque requirements dictate. The lower the torque required, the lower the current draw, while the motor attempts to maintain a constant speed, determined by the set voltage. A preferred model of the Maxon motor is model number 2322.982-11.225-200. The preferred Maxon gearhead model number is GP022A023-04.4A1A00A. The motor is provided with electrical power from an electrical storage battery (not shown) provided elsewhere in the tool and connected to the motor by electrical conductors (not shown). A shaft 72 is rotatedly driven by the DC motor and planetary gear. An attached alignment sleeve 74 rotates with the shaft and is journaled in needle roller bearings 76 and thrust bearings 78. Alternatively, other bearing types, such as radial bearings, could be used. An enlarged diameter lower portion of the shaft 72 is threaded to provide a threaded drive shaft 80. The drive shaft 80 engages mating threads on a ball nut 82. Torque shaft 84 is attached to and rotates with the ball nut 82 and is centered for rotation by bearings 86. An antirotation pin 88 engaging an antirotation bushing 90 retains the torque shaft and ball nut against rotation, so that as the threaded drive shaft is turned by the DC motor, the ball nut and torque shaft will move longitudinally upward with respect to the housing 58. Pilot valve stem 91 transmits the linear movement to the pilot valve tip 92, which is adapted to engage the pilot valve seat 94 carried in pilot valve housing 96. A metal bellows assembly 95 extends between the upper part of the pilot valve tip and the bearings 86, in surrounding relationship to the pilot valve stem 91. As explained below, the metal bellows serves as a resilient means, providing spring energy to reseat the pilot valve automatically at the end of the pulse cycle.

Below the pilot valve housing 96 is the main valve piston 98, adapted to move vertically within the inside diameter of the tool housing 58. The main valve stem 100, guided by the housing 58 and by centralizer bushing 102, transmits linear movement of the main valve piston to the main valve tip 104. Compression spring 106 confined between the centralizer bushing 100 and a shoulder on the main valve tip, urges the main valve tip toward the main valve seat or orifice plate 108 and into the main valve orifice 109.

It will be appreciated by those skilled in the art that providing the main valve orifice in the tool, rather than in the tubing string as do prior art tools, produces several advantages. First, the orifice and valve tip can be retrieved by wire line, along with the tool, so that the orifice and valve tip sizes can be changed as desired to adjusted the strength of the pressure pulse created when the main valve is closed Secondly, by including the main valve orifice in the body of the tool, the orifice is removed when the tool is removed, so that the tubing string is free of a permanent obstruction and the resulting pressure drop which otherwise would result from leaving the orifice plate in the tubing string.

With the parts in the position shown in FIGS. 2*a*–3*a*, the pilot valve is closed and the main valve is open. All drilling mud passing down the annulus 65 between the pulser tool and the inside diameter of the drill pipe enters the main mud orifices 110, flows downward through the bore of the main valve orifice 109, the bore of the muleshoe stinger 60, and on to the drill bit.

Pilot bore 112 formed through the main valve tip, main valve stem and main valve piston communicates, through horizontal pilot passages 114 with the upper main piston chamber 116 to permit drilling mud pressure to be exerted on the top of the main valve piston 98. Orifices 118 through tool housing 58 communicate with lower main piston chamber 120, to permit annulus drilling mud pressure to be exerted on the bottom of the main valve piston. Upper orifices 122 admit drilling mud from the annulus to the pilot valve chamber 124 above the pilot valve 92; however, since the pilot valve is closed, the mud in pilot valve chamber 124 is not in communication with that in the upper main piston chamber 116. The area 126 inside the metal bellows assembly 95 and in surrounding relationship to pilot valve stem 92 is filled with lubricating oil, which serves to lubricate the threaded drive shaft 80 and ball nut assembly 82. Pressure compensator membrane 128 is exposed to the pressure of drilling mud in annulus through pressure compensator orifices 130 and serves to equalize the pressure of the lubricating oil with that of the drilling mud.

The size, shape and positions of the main mud orifices 109, main valve orifice 108 and main valve tip 104 are such that a Venturi effect is created as the drilling mud flows past the bottom of the main valve tip, through main valve orifice 109 and into the bore of the muleshoe stinger 60. The pressure at this point, denominated P1, is somewhat lower than the pressure of mud flowing through the annulus. Since the pilot valve is closed, a pressure of P1 will act on the top of the main valve piston. The somewhat higher fluid pressure from the annulus, denominated P2, will act on the bottom of the main valve piston through orifices 118 and cavity 120. The pressure differential thus created is sufficient to overcome the closing force of main valve spring 106, as well as the entraining force of the mud flowing past the main valve tip, so that the main valve is biased toward the open position shown in FIG. 3*a*.

When it is desired to create a mud pulse for MWD telemetry purposes, the sensor transducer components carried in the upper part of the tool (not shown) actuate the ironless rotor DC motor 66. This causes the pilot valve 92 to lift off the valve seat 94 and permits drilling mud from the pilot orifices 122 and pilot chamber 124 to communicate through pilot bore 112 to the top of the main valve piston 98. Since this will be at substantially the same pressure, P2, as the mud acting on the bottom of the main valve piston, the pressure across the main valve piston will be substantially equalized. The main valve spring 106, together with the entraining force of drilling fluid flowing around the main valve tip 104, will cause the main valve tip to enter the main valve orifice 108, substantially reducing the flow of drilling mud to bit. To reduce wear, it is preferred that the main valve tip be slightly smaller in outside diameter than the inside diameter of the main valve orifice, so that a minor amount of mud may continue to flow around the main valve tip. Additional mud flow to the bit occurs through the pilot orifices 122 and pilot bore 112; however, the total mud flow from the annulus through the pulser tool is substantially reduced when the main valve closes, with the effect that a pressure wave is created in the mud flowing in the annulus, which wave is transmitted through the mud up to the surface for decoding and interpretation as discussed above.

The pulser tool is shown with the main valve closed and pilot valve open in FIGS. 3*a*–3*b*. So long as the pilot valve remains open, the main valve will remain closed. However, the length of the pulse may be accurately controlled by the timing means 69 which will interrupt electrical power to the motor 66 at a preselected interval after the motor is energized. The interval selected is such that it will terminate the upward movement of the pilot valve before ball nut 82 engages the housing for bearing 76, or any other obstruction, since this would cause an increase in torque on the motor and a concomitant increase in power usage. When it is not energized, the rotor of the DC motor 66 is free wheeling, subject only to frictional losses. Once the motor is de-energized, the downward force exerted on ball nut 82 by the metal bellows 95, which was cocked during the opening of the pilot valve, will exert a reverse torque on the threaded shaft. This will cause the shaft to reverse direction, permitting the ball nut, torque shaft and pilot valve to move downward to return the pilot valve to its seat.

As will be apparent to those skilled in the art, the metal bellows 95 serves both the function of providing a spring means for returning the pilot valve to its seat and providing a diaphragm separating mud flowing around the outside of the spring bellows from lubricating oil contained inside the metal bellows. If preferred, these functions can be separated by replacing the metal bellows 95 with a flexible diaphragm of rubber or another suitable polymer to insulate the lubricating oil from the mud and positioning a conventional coil spring in surrounding relationship to the lower portion of the valve stem 91, to provide the desired pilot valve spring means for returning the pilot valve to its seat.

With this arrangement, it is apparent that the duration of a mud pulse cycle can be controlled by the timing means 69. The timing means controls the duration of the opening stroke, and the length which the ball nut 82 travels up the threaded shaft 80 while the motor is energized, controls the timing of the closing stroke, responsive to spring means 95. The duration of the pulse may therefore be controlled automatically by the electronics in the pulser tool by adjusting the timing means 69. For example, different sensor transducers may utilize different intervals for the pressure pulses in order to identify the sensor or may vary the length of pulses in order to convey additional binary coded information to the surface computer. Additional control for the duration of the pulse cycle, if desired, may be provided using the optional circuitry of FIG. 8 in conjunction with the DC motor 66, as described in greater detail below.

An important feature of the design of the apparatus is the diameter to pitch ratio of the mating threads on the shaft 80 and ball nut 82, since this controls the amount of torque required to reverse direction of the shaft 80. The maximum preferred ratio of OD of the male threads on shaft 80 to the pitch between adjacent threads is from about 2.5 to 1 to 3 to 1. For a one-fourth inch diameter shaft this would require a minimum pitch between adjacent threads of from 0.1 to 0.083 inches. This ratio, together with frictional losses, controls the force required to automatically close the valve after the motor is de-energized. A higher diameter to pitch ratio would require more torque to close the valve which, in turn, would require a stronger spring force from the metal bellows 95. While a stronger spring force could be provided, this would consume more power during the opening cycle of the valve in order to cock the spring to provide the required closing force.

Once the pilot valve re-seats, mud flow through the pilot bore 112 will be interrupted and the much lower pressure from below the closed main valve will be communicated through pilot bore 112 to the upper cavity 116 and will act on the top of the main valve piston 98. This low pressure will be offset by the much higher annulus pressure of the mud flow in the annulus operating on the bottom of the piston through orifices 118 and lower cavity 120. The resulting pressure imbalance will cause the main piston valve to move upward, against the force of main valve spring 106, to return the main valve to its open position. This arrangement has the advantage of requiring power for the pilot valve only on the opening stroke, with power then being cut off and the pilot valve closing automatically.

The speed of closure of the pilot valve also is controlled by rotation of the ball nut 82 to prevent "snap-closure" which could cause excessive stress and wear on the pilot valve parts.

Figure 5:
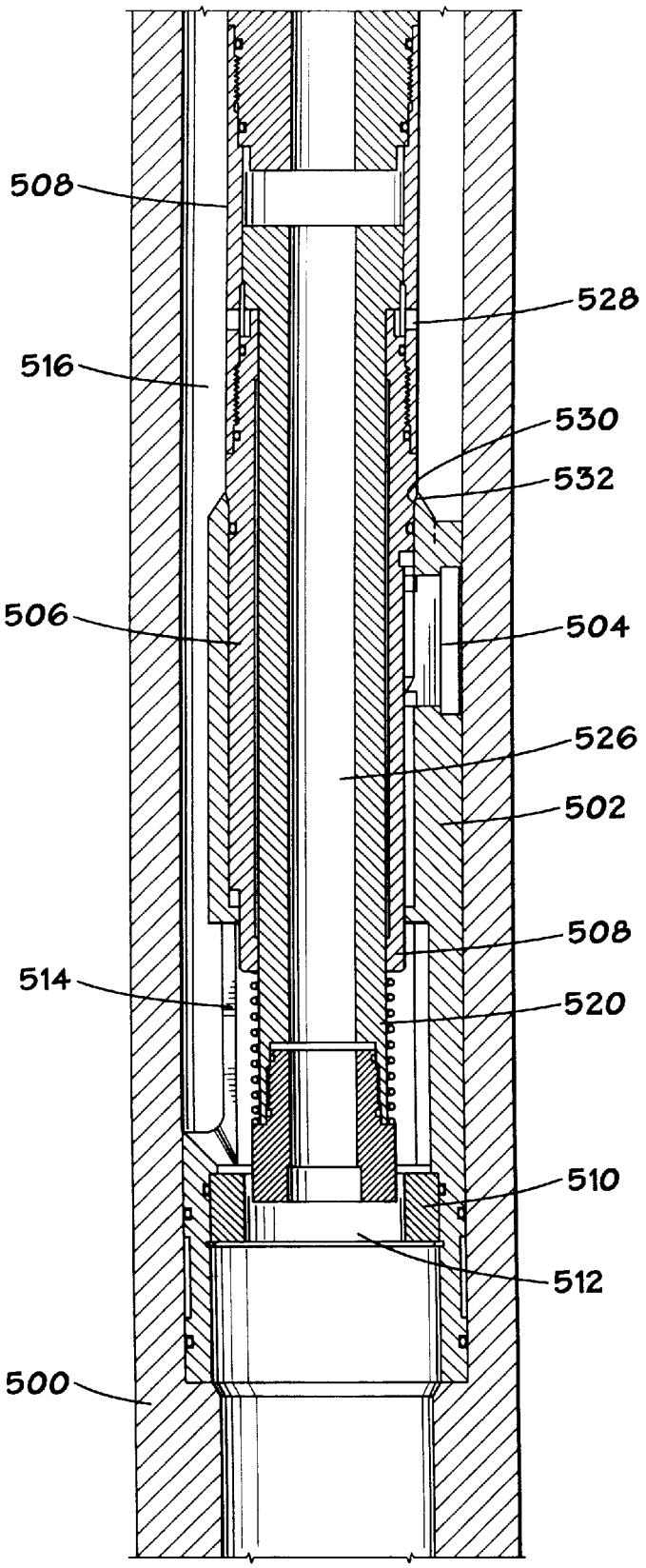
FIG. 5 is a fragmentary view, in elevation and partly in section, illustrating an alternate embodiment of the MWD mud pulser according to the present invention which cooperates with a main valve orifice carried by the tubing string.

Referring now to FIG. 5, there is illustrated an alternate embodiment of the MWD mud pulser according to the present invention. Unlike the embodiment of FIGS. 2–4, the FIG. 5 embodiment utilizes a flow obstruction in the form of an orifice fixed permanently in the mud flow path, even if the pulser tool is removed. Accordingly, it is most desirable for use with larger diameter tubing strings (typically 4¾% OD tubing or larger) which can tolerate such a permanent restriction without substantially affecting efficiency of mud flow to the bit when the pulser is not in place.

In the FIG. 5 embodiment, the orientation sub 500 in which the pulser tool is to be seated includes an orientation sleeve 502 fixed in the orientation sub and an orientation key 504 attached to the sleeve. A muleshoe stinger 506, having a downwardly facing helical surface on the lower end thereof, is carried on the elongated body 508 of the pulser tool and engages the orientation key and orientation sleeve to position and orient the pulser tool as it is run into orientation sub. The orientation sleeve 502 also carries a main orifice plate 510 which defines the main orifice 512. One or more ports 514 in the wall of the orientation sleeve 502 permit mud flow from the annulus 516 through the orifice 512 and then to the drill bit at the bottom of the tool string. A main valve tip 518 and main valve stem 520 extend below the bottom of the pulser tool housing 508 to cooperate with the main orifice 512. A main valve spring 522 confined between the main valve tip and the bottom of the valve housing urges the main valve tip toward a closed position. Mud pressures acting on the main valve piston 524 through pilot passageway 526 and through ports 528 in the tool housing control the operation of the main valve piston. The position of the pilot valve (not shown in FIG. 5) in turn controls the mud pressure acting on the top of the main valve piston as discussed above in connection with the embodiment of FIGS. 2*a*, 2*b*, 3*a*, 3*b*. The remainder of the pulser, not shown in FIG. 5, corresponds to the embodiment disclosed above in connection with FIGS. 2*a*, 2*b* and 3*a*, 3*b*.

In both versions of the MWD pulser illustrated in FIGS. 2*a*, 2b, 3*a*, 3*b*, 4 and 5, the muleshoe stinger at the lower end of the pulser cooperates with an orientation sub for orienting the pulser in the well bore. However, the seating of the MWD tool on the orientation sub occurs at opposed inclined annular shoulders on the pulser tool and the orientation sub. For example, in the FIGS. 3*a*/3*b*, the downwardly facing shoulder 62 on the muleshoe stinger cooperates with a corresponding upwardly facing shoulder 63 on the orientation sub to provide a seat for the pulser. In the larger diameter version, as illustrated in FIG. 5, a downwardly facing shoulder 530 on the MWD tool stinger cooperates with an upwardly facing shoulder 532 on the orientation sub to provide a seat for the pulser. A drawback with this arrangement is that the upwardly facing seating surface or shoulder on the orientation sub, which is near the stop of the orientation sub, is subject to periodic impacts from the lower end of the muleshoe stinger on the pulser and to wear from vibration, etc., during the use of the pulser. This can require frequent repair or replacement of the orientation subs used with the pulser.

Figure 6A:
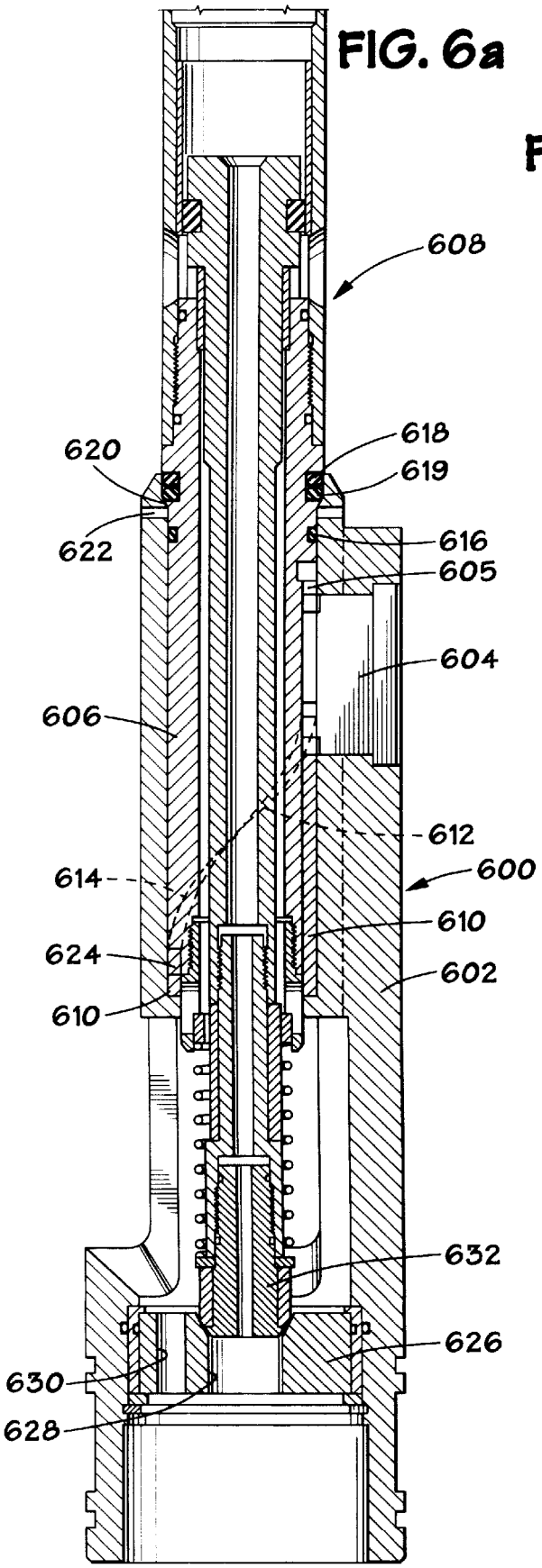
FIG. 6*a* is a fragmentary view, in elevation and partly in section, illustrating an alternate embodiment of the MWD mud pulser in which the helical downwardly facing surface on the MWD pulser stinger cooperates with a helical upward facing surface on the orientation sub to provide means for seating the pulser tool in the drill string, the parts being shown in FIG. 6*a* with the main valve in the closed position.

Referring to FIGS. 6*a*/6*b* there is shown an alternate embodiment of the pulser stinger and orientation sub in which this problem is eliminated by utilizing the helical surface of the MWD stinger for both orientation and seating of the pulser on the sub.

Referring to FIG. 6*a*, there is illustrated a modified version of the MWD mud pulser which, like the FIG. 5 embodiment, utilizes a flow obstruction in the form of a orifice fixed permanently in the flow path, even when the pulser is removed. In the FIG. 6*a* embodiment, the orientation sub 600 includes an orientation sleeve 602 and an orientation key 604 attached to the sleeve. A muleshoe stinger 606 is carried on the elongated body 608 of the pulser tool and engages the orientation key and orientation sleeve to position and orient the pulser tool as it is run into the orientation sub. The orientation sub 600 would be carried by the tubing string in the same manner shown in FIG. 5. However, in FIGS. 6*a* and 6*b*, the tubing string is not shown, so that the remaining parts may be shown enlarged and in greater detail.

Figure 6B:
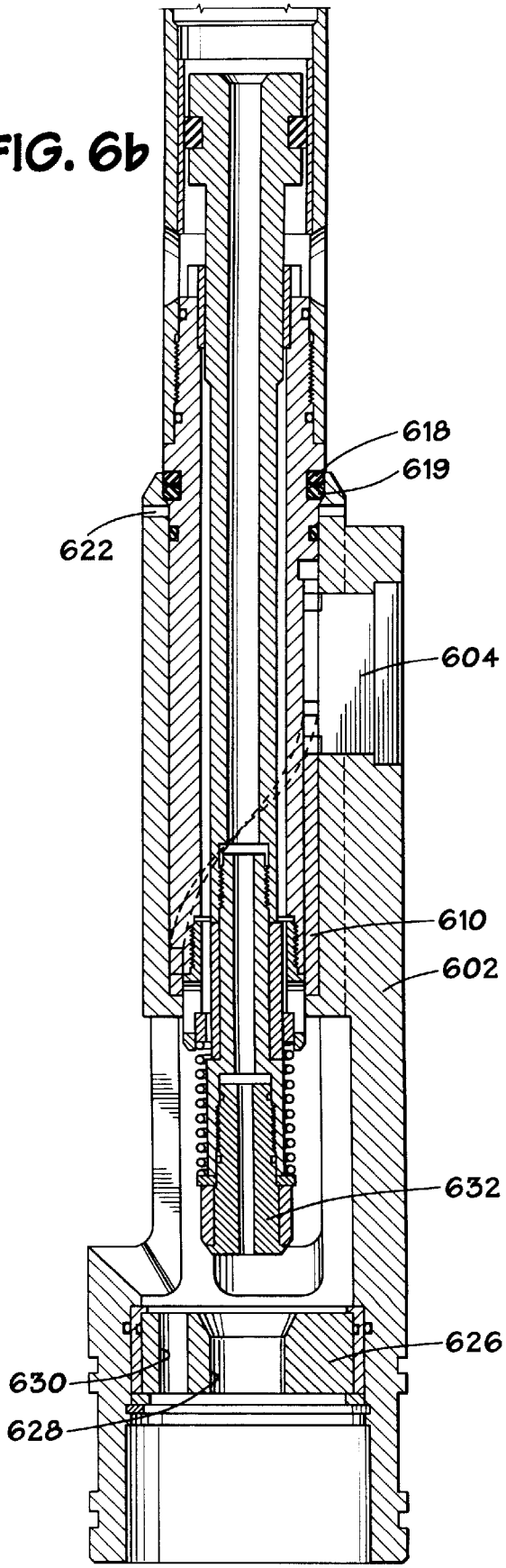
FIG. 6*b* is a view similar to FIG. 6*a*, illustrating the arrangement of the same parts of the tool with the main valve in the open position.
Figure 7:
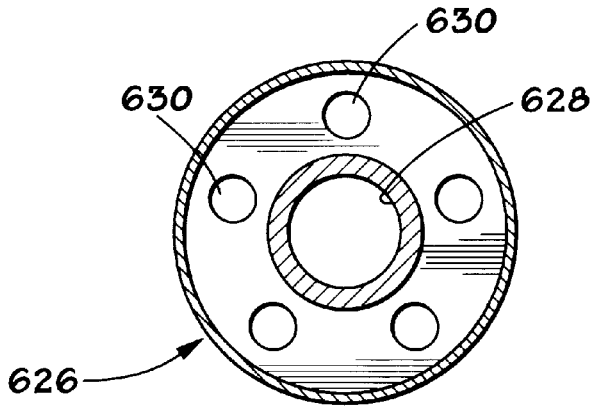
FIG. 7 is an enlarged detail plan view of the main valve orifice plate of FIGS. 6*a* and 6*b*, illustrating the orifice arrangement of a primary center flow hole path, surrounded by a pattern of smaller flow holes.

The orientation sub 600 includes on the interior thereof a replaceable hard metal insert 610 which provides an upwardly facing helical shoulder 612 which is adapted to cooperate with the downwardly facing helical surface 614 at the bottom of the MWD stinger 606. Since, as shown in FIG. 6*a* and 6*b*, the upwardly facing helical shoulder 612 in the orientation sub and the downwardly facing helix 614 at the bottom of the MWD stinger are mated, they are illustrated in phantom lines. The replaceable insert 610 also engages, and is held against rotation by, the key 604.

The MWD stinger, orientation sleeve and replaceable insert 610 preferably are so dimensioned and configured that the opposed upwardly and downwardly facing helical surfaces 612 and 614 act as the seating surface for the MWD tool in the orientation sub, when the MWD stinger 606 is fully inserted into the orientation sub. An O-ring 616 carried by the MWD stinger 606 provides a fluid seal between the outside diameter of the MWD stinger and the inside diameter of the orientation sleeve. Two larger diameter O-rings 618, 619 carried by the MWD stinger 606 are compressed against an upwardly facing shoulder 620 on the orientation sub to provide resilient means between the MWD pulser and the orientation sub for avoiding shock loading and for absorbing vibration between the MWD tool and the orientation sub during operation of the MWD pulser. A plurality of openings 622 provided radially through the body of the orientation sub between the fluid seal O-ring 616 and the shock absorbing O-rings 618, 619 permit fluid communication to prevent pressure locking of the parts which otherwise could occur if the parts were assembled without the openings and then subjected to high pressure.

The orientation sub 600 preferably is assembled into the tubing string and run into the well bore as part of the tubing string. When it is desired to mount the MWD pulser in the orientation sub, it is run into the well on a wire line until the MWD stinger 606 enters the central bore of the orientation sub. As the tool is lowered further, the downwardly facing helical surface 612 on the bottom of the MWD stinger engages the orientation key 604, causing the MWD tool to rotate about its longitudinal axis until the key way 605 on the MWD stinger is aligned with the key 604, at which point the MWD pulser and stinger will then drop down relative to the orientation sub until the downwardly facing helical surface 614 on the bottom of the MWD stinger engages the upwardly facing helical shoulder 612 on the replaceable insert 610 in the orientation sub, at which point further downward movement of the MWD pulser relative to the orientation sub is arrested. A small space 624 is provided at the bottom of the helical surface on insert 610 for accommodating the point or tip of the MWD stinger, so that the tip of the stinger does not carry the loading weight of the MWD pulser. This will bring the parts into the relative positions shown in FIGS. 6*a*, 6*b* with the MWD tool fully seated on the orientation sub.

The orientation sleeve 602 also carries a main orifice plate 626 which varies from the construction of the main valve orifice plates of FIGS. 3*a*/3*b*, 4 and 5. In the constructions of FIGS. 3*a*/3*b*, 4 and 5, the main valve orifice plate contains a single central opening or main valve orifice which preferably is of slightly larger inside diameter than the outside diameter of the main valve tip, so as to allow continued circulation of some portion of the drilling mud around the main valve tip and through the main valve orifice, even when the main valve tip extends into the orifice as to reduce the flow area and increase pressure so as to create a positive pulse in the mud stream.

With the alternate main valve orifice plate 626, there is a primary central opening or main valve orifice 628 surrounded by a plurality of smaller openings or secondary orifices 630. The main valve tip 632 is dimensioned to seat upon and fully close the central orifice 628, redirecting the remaining flow of the mud through the plurality of smaller secondary orifices 630. With this arrangement, the sudden complete closure of the primary flow path through the central opening 628, and resulting redirection of mud flow to other paths, creates a more rapid rise in the mud pressure upstream of the main valve orifice plate, which in turn creates a more easily detectible pressure pulse in the mud stream. This permits the orifice plate to be designed with a larger overall flow area (the total area of the main and secondary orifices) than is possible with the single orifice plate, so as to improve mud flow to the bit and reduce mud flow pressure drop due to the orifice plate, without sacrificing clarity and detectability of the mud pulses at the surface.

Additionally, with the orifice plate as illustrated in FIGS. 3*a*/3*b*, 4 and 5, even when the main valve is in an open position, fluid velocities of mud flowing around the bottom of the main valve shaft and tip toward the large central opening in the orifice tends to create a suction effect which could exert sufficient downward force on the main valve stem to move the main valve stem and tip slightly closer to the orifice opening, thereby partially closing the gap between the main valve tip and the orifice and resulting in a higher pressure loss across the main valve while in the open position. The alternate design for the orifice plate of FIGS. 6*a*/6*b* and 7 reduces this effect by directing a portion of the mud flow radially outwardly into the plurality of side openings 630, which tends to reduce the suction effect on the main valve tip 632.

The remainder of the pulser, not show in FIGS. 6*a*/6*b* and 7, corresponds to embodiment discussed in connection with FIGS. 5 and 2*a*/2*b*, 3*a*/3*b* and 4.

As will be apparent to those skilled in the art, although the modified main valve orifice plate 626 is shown in connection with an MWD pulser embodiment in which the orifice plate is carried by the orientation sub, a similar modification could be made in the design of the main valve orifice plate 108 and main valve tip 104 to permit the advantages of that design to be used in the smaller diameter version of the MWD pulser as illustrated in FIGS. 2*a*, 2*b*, 3*a*, 3*b* and 4 in which the main valve orifice plate is carried in the body of the MWD pulser. Similarly, the advantages of the orientation sub 600 including a replaceable insert 610 providing an upwardly facing helical shoulder adapted to be engaged by the helical surface on the bottom of the MWD stinger for seating the pulser on the sub could be utilized in conjunction with the version of the pulser shown in FIGS. 2*a*/2*b*, 3*a*/3*b* and 4.

Figure 8:
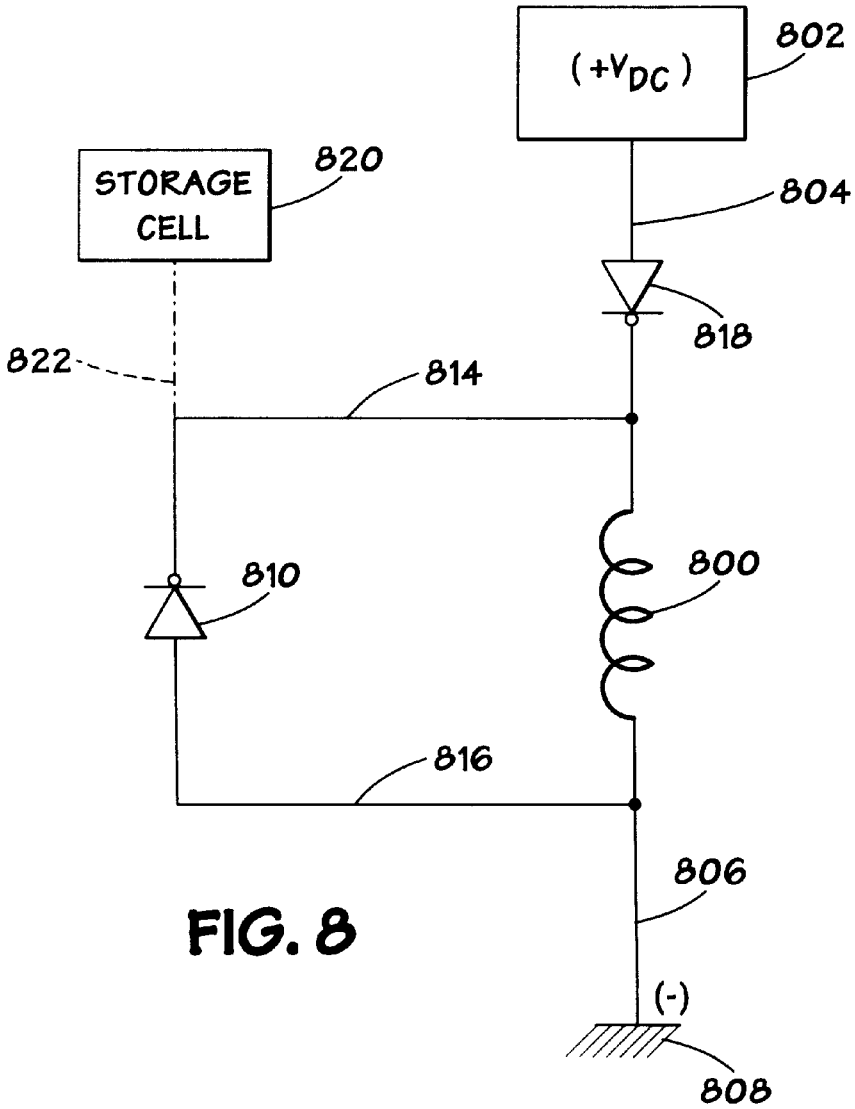
FIG. 8 is a schematic illustration of optional circuitry which may be used in conjunction with the ironless rotor DC electrical motor in the pulser servo-mechanism to provide electrical means for selectively retarding the speed of the closing portion of the servo mechanism cycle.

In FIG. 8 there is shown optional additional circuitry which may be used in connection with the ironless rotor DC motor 66 to provide electrical means for selectively retarding the speed of the closing portion of the pilot valve cycle. In FIG. 8, coil 800 represents the electrical winding of the ironless rotor or 66. Coil 800 selectively is energized by electrical power flowing from a positive DC voltage source 202, through electrical connector 804, to the coil 800 and from the coil 800 through electrical connector 806 to the ground 808, whenever DC motor 66 is powered to operate the pilot valve means.

As described above, as the pilot valve means nears the upper limit of its opening cycle, timer means are actuated to disconnect power from the DC motor 66. Once the motor is deenergized, the downward force exerted on ball nut 82 by the spring means 95, which was cocked during the opening of the pilot valve cycle, will exert a reverse torque on the threaded shaft. This will cause the shaft to reverse direction, permitting the ball nut, torque shaft and pilot valve to move downward to return the pilot valve to its seat. During this closing portion of the pilot valve cycle, the rotor in the DC motor will free-wheel. Since there are no loads to be overcome during the closing portion of the pilot valve cycle, except for frictional forces, the closing portion of the cycle can occur very quickly. It is desirable, in order to increase control over the duration of the full cycle, as well as to avoid damage to the pilot valve and pilot valve seat from too-rapid closing, to selectively retard the speed of the pilot valve on its closing cycle. This may be done utilizing the optional additional circuitry of FIG. 8.

As is well known to those skilled in the art, when a DC electric motor is run backwards against a load, it operates as a generator. By providing an electrical diode 810, or other electrical resistance means, in parallel with the coil 800 of the DC motor 66, and electrically connected to the coil 800 through connectors 814 and 816, the flow of current generated by the DC motor during the pilot valve return step is substantially impeded, thereby forcing the motor 66 to operate as a generator and to dissipate generated heat via the motor coil 800. The rate at which generated heat can be dissipated effectively by the coil 800 controls the speed at which the motor turns, thereby selectively retarding the closing speed of the pilot valve responsive to the metal spring means 95. Diode 810 electrically connected in parallel with the motor coil 800 therefore provides electrical means for selectively retarding the speed of the closing portion of the pilot valve cycle.

One or more in-line diodes 818 also may be provided in electrical connector 804 in order to prevent reversed polarity and to protect the other electrical components of the system from the DC current generated by the motor 66 during closing of the pilot valve.

If desired, an electrical storage means, such as the storage cell 820, or other battery or capacitor, may be electrically connected, as by connector 822, into the circuitry so as to absorb and store a portion of the electrical energy generated by the coil 800 as the DC electric motor 66 is operated in reverse against a load during the closing cycle of the pilot valve. The electrical energy thus recovered and stored in the electrical storage means then would be available for use in powering other operations of the tool, such as providing a portion of the electrical power needed for operating the DC electric motor 66 to open the pilot valve on the next pulse cycle.

The foregoing disclosure and description of the invention are illustrative thereof, and various embodiments of the tool may be made through changes in the size, shape, arrangement of parts and materials of construction, without departing from the spirit of the invention, which is measured solely by the appended claims.

What is claimed is:

1. A pulser apparatus responsive to a signal from a downhole sensor for creating a positive pressure pulse in a column of drilling fluid being circulated through a drill string to a drill bit, said apparatus comprising:

a wire-line retrievable assembly adapted to be received within the bore of the drill string;

seating means on the retrievable assembly for seating the assembly in the lower portion of the drill string, above the drill bit, in a position substantially blocking the flow of drilling fluid around said assembly, so that a major portion of the drilling fluid which flows to said drill bit will flow through an annulus between said assembly and said drill string and through a fluid passageway in said assembly, before being supplied to said drill bit;

a main bore in the assembly having an inlet and outlet through which a major portion of the drilling fluid which flows to said bit may flow, said inlet for said main bore being in communication with said annulus and the outlet of said main bore being in communication with said drill string below said assembly;

main valve means in said assembly for selectively restricting the flow of drilling fluid through said main bore, said main valve means comprising, orifice means defining a main orifice in said main bore, a valve tip in said main bore above said main orifice and adjustable toward and away from said main orifice to adjust the amount of drilling fluid flowing through said main bore;

a main valve spring for urging said main valve tip toward said main orifice, a main valve piston connected to said main valve tip by a main valve stem, a cylinder in surrounding relationship to said main valve piston and comprising an upper chamber above said main valve piston and a lower chamber below said main valve piston;

a first fluid passageway in said assembly having an inlet in communication with said main bore and an outlet in communication with said upper cylinder chamber for supplying drilling fluid at a pressure substantially equal to the pressure in said main bore below said main valve tip to said upper cylinder chamber;

a second fluid passageway in said assembly having an inlet in communication with said annulus and an outlet in communication with said upper cylinder chamber for supplying drilling fluid at a pressure substantially equal to that of the drilling fluid in said annulus to said upper cylinder chamber;

pilot valve means in said assembly for selectively closing said second fluid passageway responsive to a signal from said sensor; and a third fluid passageway having an inlet in communication with said annulus and an outlet in communication with said lower cylinder chamber for supplying drilling fluid at a pressure substantially equal to the pressure in said annulus to said lower cylinder chamber;

said main bore, said inlet to said main bore, said main valve tip and said orifice means being so configured, and said main valve tip being adapted to be so positioned with respect to said orifice means, when said main valve means is open, that the flow of drilling fluid through said inlet to said main bore, around said main valve tip and through said orifice means produces a first fluid pressure in said main bore at said inlet to said first fluid passageway, which first fluid pressure is lower than the annulus fluid pressure at said inlets to said second and third fluid passageways, whereby, when said pilot valve is closed, said first fluid pressure will be communicated through said first fluid passageway to the said upper chamber of said cylinder while said higher annulus fluid pressure will be communicated through said third fluid passageway to said lower cylinder chamber, creating a pressure differential across the main valve piston which is sufficient to overcome the closing effect of said main valve spring, so as to retain said main valve open and, when said pilot valve is opened responsive to said signal, said annulus fluid pressure will be transmitted through said second fluid passageway to said upper cylinder chamber, reducing the pressure differential across said main valve piston sufficiently to permit said main valve spring to cause said main valve tip to move toward said main orifice, so as to reduce the flow of drilling fluid through said main bore and create a positive pressure pulse in said drilling fluid in said drill string above said assembly.

2. The apparatus according to claim 1 comprising additionally means for operating said pilot valve, said operating means comprising:

a DC electric motor adapted to operate responsive to said control signal;

a threaded drive shaft adapted to be rotated through a plurality of revolutions about its longitudinal axis by said motor when said motor is operated;

a threaded follower on said drive shaft and held against rotation, so that said follower will move up or down responsive to rotation of said drive shaft; and a valve stem interconnecting said follower and said pilot valve tip for transmitting the vertical movement of said follower to said valve tip to open said pilot valve.

3. The apparatus according to claim 2 comprising additionally pilot valve spring means adapted to urge the pilot valve tip in a direction to close said pilot valve, whereby said DC electric motor may be operated to open said pilot valve and energy stored in said pilot valve spring means may be used to close said pilot valve.

4. The apparatus according to claim 3 comprising additionally timer means in said apparatus for discontinuing operation of said electric motor a preselected period of time after said motor has operated responsive to said control signal, to thereby control the duration of said positive pressure pulse.

5. The apparatus according to claim 3 comprising additionally electrical means for retarding the speed at which said pilot valve tip moves in a direction to close said pilot valve responsive to said pilot valve spring means.

6. The apparatus according to claim 5 wherein said electrical means comprise an electrical resistance means electrically connected in parallel with said DC electric motor, whereby said DC electric motor is caused to generate electrical energy as said pilot valve tip moves in a direction to close said pilot valve responsive to said pilot valve spring means.

7. The apparatus according to claim 6 comprising additionally electrical storage means connected to said DC electric motor for capturing and storing a portion of the electrical energy generated by said DC electric motor as said pilot valve tip moves in a direction to close said pilot valve.

8. The apparatus according to claim 2 wherein said threaded drive shaft has threads with a diameter to pitch ratio of not greater than 3 to 1.

9. The apparatus according to claim 2 wherein said electric motor comprises an ironless rotor DC electric motor.

10. The apparatus according 1 wherein said orifice means comprises an orifice plate in said main bore defining a single orifice therethrough.

11. The apparatus according to claim 1 wherein said orifice means comprises an orifice plate in said main bore defining a main orifice adapted to cooperate with said main valve tip and a plurality of secondary orifices adapted to remain substantially unobstructed during operation of said pulser apparatus.

12. The apparatus according to claim 1 wherein said seating means on said retrievable assembly comprises a downwardly facing helical surface formed at the lower end of said retirevable assembly and comprising additionally an orientation sub carried by said drill string and adapted to cooperate with said seating means, said orientation sub comprising an upwardly facing helical surface adapted to receive said downwardly facing helical surface of said retrievable assembly for seating said retrievable assembly in said orientation sub.

13. The apparatus according to claim 12 comprising additionally an orientation key in said orientation sub adapted to engage said downwardly facing helical surface of said retrievable assembly for orienting said retrievable assembly angularly with respect to said orientation sub prior to said helical surface on said retrievable assembly engaging, and seating upon, said helical surface on said orientation sub.

14. The apparatus according to claim 12 wherein said upwardly facing helical surface in said orientation sub is formed on a metal sleeve removably received within said orientation sub.

15. The apparatus according to claim 14 wherein said metal sleeve is engaged by, and held against rotation by, said orientation key in said orientation sub.

16. The apparatus according to claim 12 comprising additionally resilient shock absorbing means carried by said retrievable assembly and adapted to engage said orientation sub when said retrievable assembly is seated on said orientation sub, for reducing shock loading and vibration transmission between said retrievable assembly and said orientation sub.

17. A pulser apparatus responsive to a signal from a downhole sensor for creating a positive pressure pulse in a column of drilling fluid being circulated through a drill string to a drill bit, said apparatus comprising:

a wire-line retrievable assembly adapted to be received within the bore of the drill string;

seating means on said retrievable assembly for seating the assembly in the lower portion of the drill string in predetermined relationship to an orifice means carried by the drill string and defining a main orifice and in such a manner that a major portion of the drilling fluid which flows to said bit may flow through an annulus between said assembly and the wall of said drill string and through said orifice means in said drill string before being supplied to said drill bit;

main valve means in said assembly for selectively restricting the flow of drilling fluid through said main orifice in said orifice means, said main valve means comprising, a valve tip carried by said assembly and adjustable toward and away from said main orifice to adjust the amount of drilling fluid flowing through said main orifice, a main valve spring on said assembly for urging said main valve tip towards said main orifice, a main valve piston connected to said main valve tip by a main valve stem, a cylinder in surrounding relationship to said main valve piston and comprising an upper chamber above said main valve piston and a lower chamber below said main valve piston;

a first fluid passageway in said assembly having an inlet in communication with the lower portion of said main valve tip and an outlet in communication with said upper cylinder chamber, for supplying drilling fluid at a pressure substantially equal to that of the drilling fluid immediately below said main valve tip to said upper cylinder chamber;

a second fluid passageway in said assembly having an inlet in communication with said annulus and an outlet in communication with said upper cylinder chamber, for supplying drilling fluid at substantially the pressure in said annulus to said upper cylinder chamber;

pilot valve means in said assembly for selectively closing said second fluid passageway responsive to a signal from said sensor; and means for operating said pilot valve means, said operating means comprising, a DC electric motor adapted to operate responsive to said control signal, a threaded drive shaft adapted to be rotated through a plurality of revolutions about its longitudinal axis by said motor when said motor is operated, a threaded follower on said drive shaft and held against rotation, so that said follower will move up or down responsive to rotation of said drive shaft, and a valve stem interconnecting said follower and said pilot valve tip for transmitting the vertical movement of said follower to said valve tip to open said pilot valve;

a third fluid passageway having an inlet in communication with said annulus and an outlet in communication with said lower cylinder chamber for supplying drilling fluid at a pressure substantially equal to the pressure in said annulus to said lower cylinder chamber;

said orifice means and said main valve tip being so dimensioned and configured, and said main valve tip being adapted to be so positioned with respect to said orifice means, when said main valve means is open, that the flow of drilling fluid around said main valve tip and through said orifice means produces a first fluid pressure at the inlet to said first fluid passageway which first fluid pressure is lower than the annulus fluid pressure at said inlets to said second and third fluid passageways, whereby, when said pilot valve is closed, said first fluid pressure will be communicated through said first fluid passageway to said upper chamber of said cylinder, while said higher annulus fluid pressure will be communicated through said third fluid passageway to said lower cylinder chamber, creating a pressure differential across said main valve piston which is sufficient to overcome the closing effect of said main valve spring means, so as to retain said main valve open and, when said pilot valve is opened responsive to said signal, said annulus fluid pressure will be transmitted through said second fluid passageway to said upper cylinder chamber, reducing the pressure differential across said main valve piston sufficiently to permit said main valve spring means to cause said main valve tip to move towards said main orifice, so as to reduce the flow of drilling fluid through said main orifice and create a positive pressure pulse in said drilling fluid in said drill string above said assembly.

18. The apparatus according to claim 17 comprising additionally pilot valve spring means adapted to urge the pilot valve tip in a direction to close said pilot valve, whereby said DC electric motor may be operated to open said pilot valve and energy stored in said pilot valve spring means may be used to close said pilot valve.

19. The apparatus according to claim 17 comprising additionally timer means in said apparatus for discontinuing operation of said electric motor a preselected period of time after said motor has operated responsive to said control signal, to thereby control the duration of said positive pressure pulse.

20. The apparatus according to claim 18 comprising additionally electrical means for retarding the speed at which said pilot valve tip moves in the direction to close said pilot valve responsive to said pilot valve spring means.

21. The apparatus according to claim 20 wherein said electrical means comprise electrical resistance means electrically connected in parallel with said DC electric motor, whereby said DC electric motor is caused to generate electrical energy as said pilot valve tip moves in the direction to close said pilot valve responsive to said pilot valve spring means.

22. The apparatus according to claim 21 comprising additionally electrical storage means connected to said DC electric motor for capturing and storing a portion of the electrical energy generated by said DC electric motor as said pilot valve tip moves the direction to close said pilot valve.

23. The apparatus according to claim 17 wherein said threaded drive shaft has threads with a diameter to pitch ratio of not greater than 3 to 1.

24. The apparatus according to claim 17 wherein said orifice means comprises an orifice plate defining a single orifice therethrough.

25. The apparatus according to claim 17 wherein said orifice means comprises an orifice plate defining a main orifice adapted to cooperate with said main valve tip and a plurality of secondary orifices adapted to remain substantially unobstructed during the operation of said pulser apparatus.

26. The apparatus according to claim 17 wherein said seating means on said retrievable assembly comprises a downwardly facing helical surface formed at the lower end of said retrievable assembly and comprising additionally an orientation sub carried by said drill string and adapted to cooperate with said seating means, said orientation sub comprising an upwardly facing helical surface adapted to receive said downwardly facing helical surface of said retrievable assembly for seating said retrievable assembly in said orientation sub.

27. The apparatus according to claim 26 comprising additionally an orientation key in said orientation sub adapted to engage said downwardly facing helical surface of said retrievable assembly for orienting said retrievable assembly angularly with respect to said orientation sub prior to said helical surface on said retrievable assembly engaging, and seating upon, said helical surface on said orientation sub.

28. The apparatus according to claim 27 wherein said upwardly facing helical surface and said orientation sub is formed on a metal sleeve removably received within said orientation sub.

29. The apparatus according to claim 28 wherein said metal sleeve is engaged by, and held against rotation by, said orientation key in said orientation sub.

30. The apparatus according to claim 26 comprising additionally resilient shock absorbing means carried by said retrievable assembly and adapted to engage said orientation sub, when said retrievable assembly is seated on said orientation sub, for reducing shock loading and vibration transmission between said retirevable assembly and said orientation sub.

31. An apparatus responsive to a signal from a downhole sensor for creating a positive pressure pulse in a column of drilling fluid being circulated through a drill string to a drill bit, said apparatus comprising:

an orientation sub carried by the drill string and having a central bore longitudinally therethrough, an orientation key in said orientation sub and extending into said central bore, and an upwardly facing helical surface disposed around the inside diameter of said central bore; and a wire-line retrievable mud pulser assembly adapted to be received within the bore of the drill string and seated on said orientation sub, said retrievable mud pulser assembly comprising a main valve means adapted to at least partially restrict the flow of drilling mud through the central bore of said orientation sub responsive to said signal from said downhole sensor, to thereby create a positive pressure pulse in said column of drilling fluid, and a downwardly facing helical surface on said retrievable mud pulser assembly adapted to engage said orientation key in said orientation sub as said retrievable assembly is lowered into said drill string, to thereby orient said retrievable assembly in a predetermined angular relationship to said orientation sub and to engage said upwardly facing helical surface in said bore of said orientation sub as said retrievable assembly is lowered further into said drill string, for seating said retrievable assembly in a predetermined longitudinal relationship to said orientation sub.

32. The apparatus according to claim 31 wherein said upwardly facing helical surface in said orientation sub is provided on a sleeve releasably received in said bore of said orientation sub.

33. The apparatus according to claim 32 wherein said orientation key engages said sleeve to hold said sleeve in a predetermined orientation relative to said orientation sub.

34. The apparatus according to claim 31 wherein said retrievable assembly comprises additionally resilient shock absorbing means adapted to engage said orientation sub when said retrievable assembly is seated in said orientation sub, to thereby reduce transmission of shock loads and vibrations between said retrievable assembly and said orientation sub.

* * * * *